US010677115B2

(12) United States Patent
Schroeer et al.

(10) Patent No.: US 10,677,115 B2
(45) Date of Patent: Jun. 9, 2020

(54) VALVE DRIVE DEVICE, IN PARTICULAR FOR AN INTERNAL COMBUSTION ENGINE

(71) Applicant: Daimler AG, Stuttgart (DE)

(72) Inventors: Dietmar Schroeer, Weissach im Tal (DE); Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/098,710

(22) PCT Filed: Mar. 6, 2017

(86) PCT No.: PCT/EP2017/000296

§ 371 (c)(1),
(2) Date: Nov. 2, 2018

(87) PCT Pub. No.: WO2017/190817

PCT Pub. Date: Nov. 9, 2017

(65) Prior Publication Data

US 2019/0136725 A1 May 9, 2019

(30) Foreign Application Priority Data

May 3, 2016 (DE) ..... 10 2016 005 454

(51) Int. Cl.

| | |
|---|---|
| ***F01L 1/34*** | (2006.01) |
| ***F01L 13/00*** | (2006.01) |
| *F01L 1/053* | (2006.01) |

(52) U.S. Cl.

CPC ..... *F01L 13/0042* (2013.01); *F01L 13/0036* (2013.01); *F01L 1/053* (2013.01); *F01L 13/0005* (2013.01); *F01L 2013/0052* (2013.01); *F01L 2013/10* (2013.01); *F01L 2013/101* (2013.01); *F01L 2013/103* (2013.01)

(58) Field of Classification Search

CPC ..... F01L 13/0042; F01L 2013/0052; F01L 13/0036; F01L 2013/10

USPC ..... 123/90.16, 90.18

See application file for complete search history.

(56) References Cited

U.S. PATENT DOCUMENTS 8,307,797 B2 * 11/2012 Meintschel ..... F01L 1/047 123/90.18

FOREIGN PATENT DOCUMENTS

| | | |
|---|---|---|
| DE | 10 2007 010 157 A1 | 6/2008 |
| DE | 10 2007 027 979 A1 | 1/2009 |
| DE | 10 2007 061 353 A1 | 6/2009 |
| DE | 10 2011 050 484 A1 | 11/2012 |
| WO | WO 2009/092427 A1 | 7/2009 |

OTHER PUBLICATIONS

PCT/EP2017/000296, International Search Report dated May 29, 2017 (Three (3) pages).

* cited by examiner

*Primary Examiner* — Ching Chang
(74) *Attorney, Agent, or Firm* — Crowell & Moring LLP

(57) ABSTRACT

A valve train device, in particular for an internal combustion engine, includes at least one camshaft which has at least one cam element with at least one multi-track cam. The cam element is provided to be axially displaced by a maximum displacement path. The valve train device further includes a limiting mechanism which is provided to limit in at least one operating state the displacement path of the cam element to a switching path of the switching operation.

8 Claims, 3 Drawing Sheets

VALVE DRIVE DEVICE, IN PARTICULAR FOR AN INTERNAL COMBUSTION ENGINE

BACKGROUND AND SUMMARY OF THE INVENTION

The invention concerns a valve drive device and an internal combustion engine with a valve drive device.

A valve drive device for an internal combustion engine with at least one camshaft which has at least one cam element with at least one multi-track cam, which is intended to be axially displaced by a maximum displacement path is known from DE 10 2011 050 484. The valve drive device has a latching mechanism which is intended to lock a changeover to a central cam track, but which is unlatched by the cam element at high speeds so that the cam element exceeds the desired axial displacement.

The invention is based, in particular, on the task of providing a valve drive device with which a safe switchover between valve strokes can be achieved at high camshaft speeds.

The invention is based on a valve drive device, in particular for an internal combustion engine with at least one camshaft which has at least one cam element with at least one multi-track cam, which is intended to be axially displaced by a maximum displacement path.

It is proposed that the valve drive device comprises a limiting mechanism intended to limit, in at least one operating condition, the displacement path of the cam element to a switching path for a switching operation, thereby safely limiting axial displacement of the cam element and preventing overshooting of a desired axial displacement, thus achieving safe switching between valve strokes even at high camshaft speeds. In this context, a "multi-track cam element" is understood to mean a cam element with at least two partial cams, each of which forms a cam track for actuating a gas shuttle valve, the partial cams providing different valve lift and/or valve timing. In this context, a "maximum displacement path" is understood to mean a displacement path of the cam element in which the cam element is displaced from an axial position, in which an outermost cam track is provided for actuating the gas exchange valve, to an axial position, in which an opposite outermost cam track is provided for actuating the gas exchange valve. In this context, a "switching path for a switching operation" is understood to mean an axial displacement of the cam element with which the cam element is displaced from an axial position, in which a cam track for actuating the gas exchange valve is provided, to an axial position, in which a directly adjacent cam track for actuating the gas exchange valve is provided. In particular, the switching path for a switching operation is at most equal to the maximum displacement path and, if a cam of the cam element has at least three cam tracks, less than the maximum displacement path. One length of the switching path for a switching operation corresponds in particular to one length of the maximum displacement path divided by a number that is one less than a number of cam tracks.

It is further proposed that the valve drive device comprises a positive locking element at least connected to the cam element and intended for positive connection to the limiting mechanism, thus allowing a simple construction of the valve drive device to be achieved.

It is also proposed that the limiting mechanism should have a stop element with two opposite stop surfaces for the positive locking element, so that the stop element can be used to limit the displacement to one switching path in one axial direction and one opposing axial direction, and a simple design of the valve drive device can be achieved.

Furthermore, it is proposed that the stop surfaces be spaced apart in such a way that any displacement is limited to the value of the distance between adjacent cam tracks, so that a limitation of the displacement path to a switching path for switching between adjacent cam tracks can be limited in a simple way.

It is also proposed that the limitating mechanism should include an auxiliary actuator to displace the stop element so that one switching element can be used to limit the displacement path to one switching path for switching adjacent cam tracks if more than two cam tracks of a multi-track cam are used.

It is also proposed that the valve drive device has a switching actuator for axially displacing at least one cam element, which comprises at least one switching element which is in permanent operative connection with the cam element, and a drive for axially displacing the switching element designed to be decoupled from the switching element so that, after the switching operation has been completed, when the limiting mechanism blocks further displacement of the cam element, the drive can be decoupled from the switching element and thus a precise actuation of the drive in order to limit the displacement of the cam element to the switching path can be dispensed with.

It is also proposed that the switching element be permanently connected to the positive locking element, thus eliminating the need for an additional component to engage with the switching element and simplifying the design of the valve drive device.

It is also proposed that the switching actuator should include a slipping clutch designed to decouple the switching element and the drive from each other, thus providing a simple design for decoupling the switching element from the drive.

It is also proposed that the valve drive device should include a spindle for transmitting a driving force from the drive to the switching element, which is connected to the drive via the slipping clutch, thus providing a simple design for decoupling the switching element from the drive.

It is also proposed that at least one multi-track cam should have at least three cam tracks, allowing the limiting mechanism to be used with particular benefit for safe switching between adjacent cam tracks.

Furthermore, the invention concerns an internal combustion engine with a valve drive device corresponding to the invention, which reliably limits an axial displacement of the cam element and prevents overshooting of a desired axial displacement, thus achieving safe switching between valve strokes even at high camshaft speeds.

Further advantages can be seen in the description of the figures below. The figures show an example of the invention. The figures, the description of the figures and the claims contain numerous features in combination. Experts will also consider the features individually and combine them into other useful combinations.

DETAILED DESCRIPTION OF THE DRAWINGS

Figure 1:
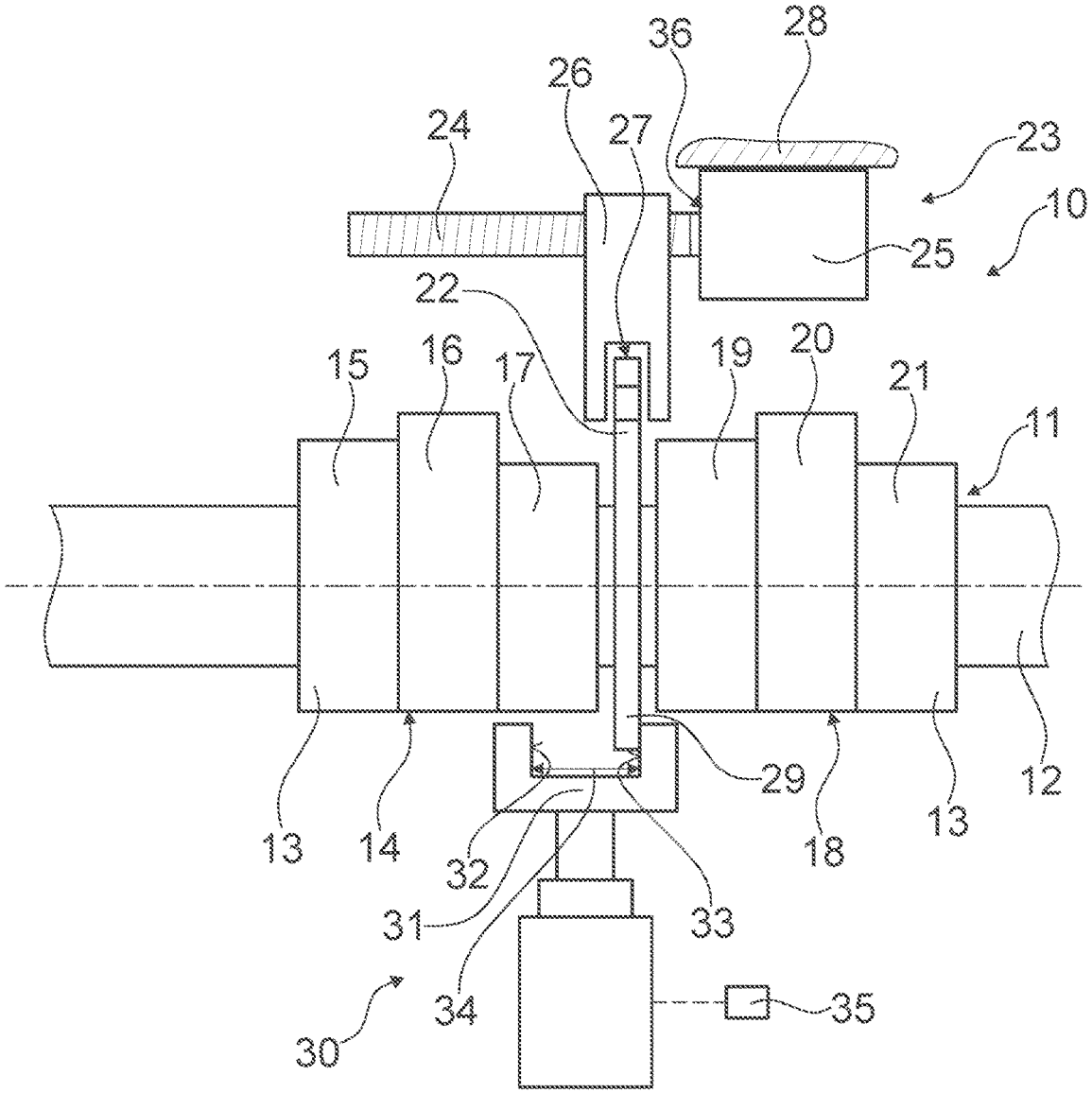
FIG. 1 is a schematic representation of a valve drive device for an internal combustion engine, having a camshaft which has a cam element with two multi-track cams, which is intended to be axially displaced by a maximum displacement path, and having a limiting mechanism which is intended, in at least one operating state, to limit the displacement path of the cam element to a switching path for a switching operation, in a first axial position of the cam element in which an outermost cam track is provided in order to actuate a gas exchange valve.
Figure 2:
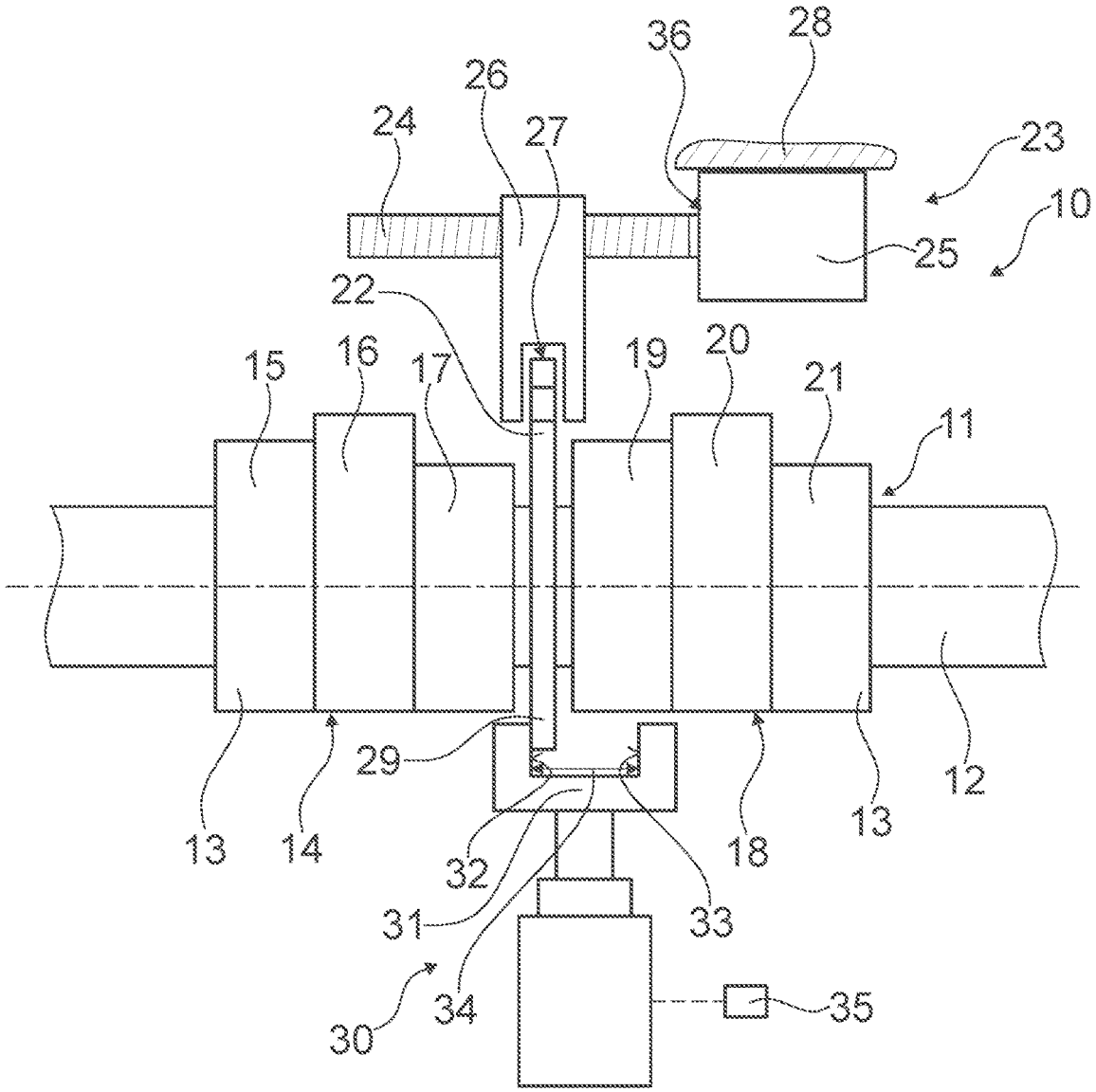
FIG. 2 illustrates the valve drive device in a second axial position of the cam element in which a central cam track is provided for actuating a gas exchange valve.
Figure 3:
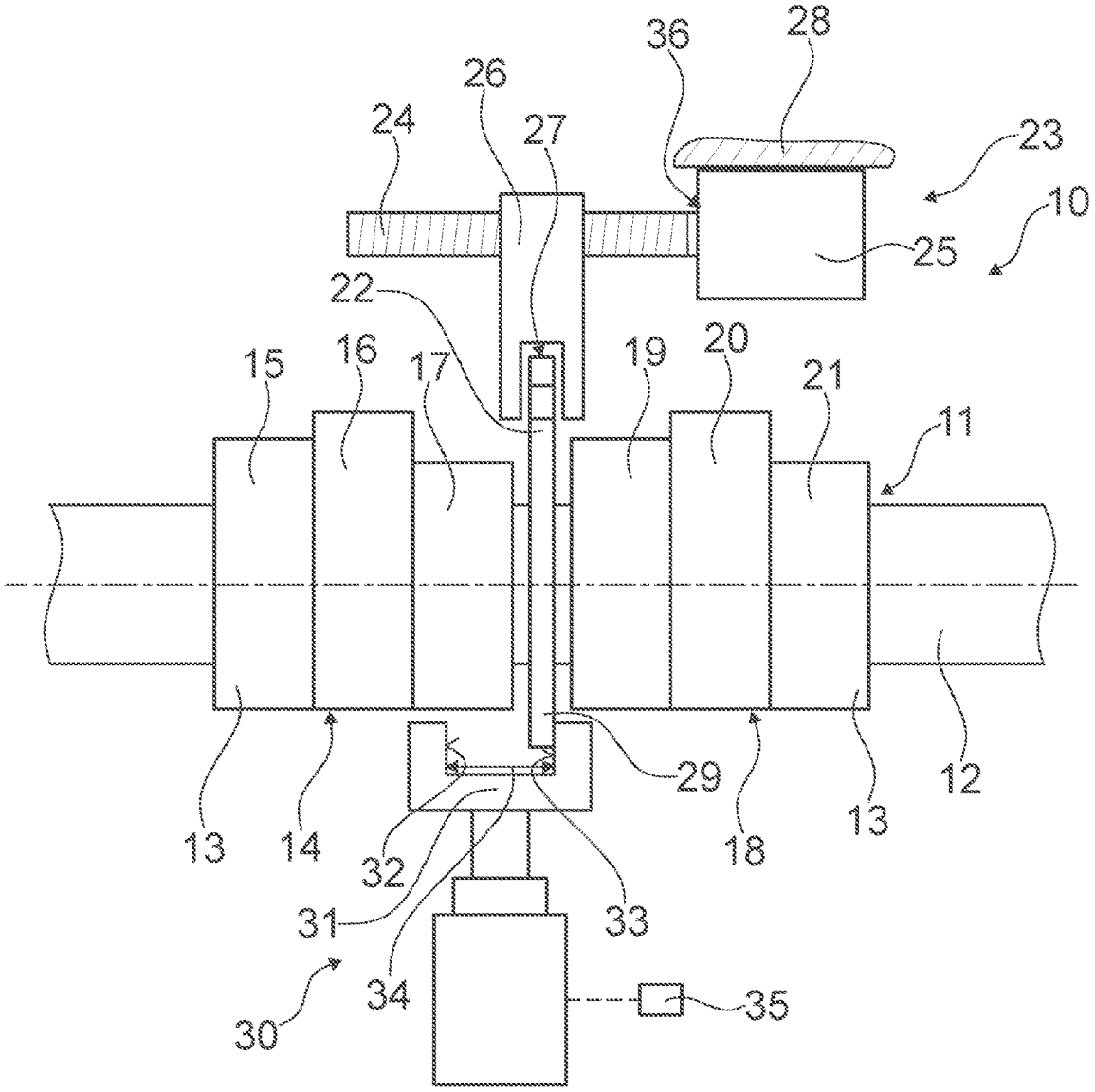
FIG. 3 illustrates the valve drive device in the second axial position of the cam element in which a central cam track is provided for actuating a gas exchange valve, the limiting mechanism being displaced in the axial direction.

FIGS. 1 to 3 show a section of an internal combustion engine with a valve drive device 10, with a camshaft 11, which has an axially displaceable cam element 13, which has two multi-track cams 14, 18, and an axially displaceable positive locking element 22, which is connected to the cam element 13. The positive locking element 22 extends along an entire circumference of the camshaft 11 and forms a circumferential engagement contour. During the displacement process for an axial displacement of the cam element 13, switching forces are applied to the engagement contour of the positive locking element 22 and displace the positive locking element 22 axially on the camshaft 11. The cam element 13 is axially displaced by connecting the positive locking element 22 to the cam element 13. In the design example shown, the positive locking element 22 is designed as a single piece with the cam element 13. In an alternative design, the positive locking element 22 can be designed separately from, but connected to, the cam element 13 and, in the event of axial displacement, can move the cam element 13 indirectly via the connection with the cam element 13. The positive locking element 22 is designed as a circumferential rib.

The camshaft 11 consists of a drive shaft 12 on which the cam element 13 is located. The drive shaft 12 has a spur toothing on its outer perimeter. The cam element 13 has a corresponding spur gearing on its inner perimeter, which meshes with the spur gearing of the drive shaft 12. The cam element 13 is mounted on the drive shaft 12, rotationally fixed but displaceable in both axial directions. The drive shaft 12 comprises a crankshaft connection for connection to an unspecified crankshaft. In alternative designs, the drive shaft 12 can be dispensed with, for example by assembling the camshaft 11 from several cam elements 13 which mesh at their edges.

The valve drive device 10 comprises a switching actuator 23 for axial displacement of the cam element 13. The two multi-track cams 14, 18 each comprise three partial cams 15, 16, 17, 19, 20, 21 with different cam tracks which form different valve lift curves. One partial cam each 15, 16, 17, 19, 20, 21 of the cams 14, 18 is in contact with an unspecified cam follower for actuating a gas exchange valve of the internal combustion engine. The switching actuator 23 moves the cam element 13 axially in order to switch between the different partial cams 15, 16, 17 of the cam 14 and the partial cams 19, 20, 21 of the cam 18, which are in contact with the cam follower. The valve drive device 10 has a permanent active connection between the switching actuator 23 and the positive locking element 22. The switching force for axial displacement of the cam element 13 is transmitted via the permanent active connection. The permanent operative connection is maintained during the entire operation of the valve drive device 10 and over a complete revolution of the camshaft 11. The cam element 13 is intended to be moved axially by a maximum displacement path. The maximum displacement corresponds to a distance by which the cam element 13 has to be moved axially in order to switch from a cam track of an outermost cam 15, 19 to a cam track of an outermost cam 17, 21.

The switching actuator 23 is arranged on a schematically illustrated camshaft housing 28 and fastened there. The switching actuator 23 consists of a housing which is firmly connected to the camshaft housing 28 and an axially displaceable switching element 26. In the example shown, the switching actuator 23 also comprises a rotatable spindle 24 and a drive 25 which drives the spindle 24 and is in the form of an electric motor. Switching element 26 is located on spindle 24. Spindle 24 is designed to transmit a driving force from drive 25 to switching element 26. The switching element 26 is moved axially by turning the spindle 24 with the drive 25. In alternative designs, the drive 25 can be used as a hydraulic motor or another drive machine instead of an electric motor. Instead of a spindle 24, a running rail or a cable device could, for example, be used to support switching element 26.

The positive locking element 22 forms an interface for applying the switching force acting in the axial direction to the cam element 13. The switching force acting in the axial direction is applied only by the switching actuator 23 and is independent of a rotary movement of the camshaft 11. The course of an axial displacement movement is determined solely by the switching actuator 23 via the drive 25, which drives the spindle 24 and thus displaces the switching element 26. The switching element 26 has an engagement groove 27, which is intended for engagement with the positive locking element 22. The positive locking element 22 is designed as a circumferential rib. In alternative designs, the positive locking element 22 can be designed as a groove and the switching element 26 as a rib or pin.

The permanent active connection between the switching actuator 23 and the positive locking element 22 may have an active surface which is dependent on a rotation angle of the camshaft 11 and which is adapted in a rotation angle range to the switching forces to be transmitted in the rotation angle range. The active surface, which depends on the angle of rotation of the camshaft 11, can be achieved, for example, by different radial extensions of the positive locking element 22 in the angle of rotation ranges, in which different switching forces occur.

The valve drive device 10 comprises a limiting mechanism 30, which is intended to limit, in at least one operating condition, the displacement path of the cam element 13 to a switching path for a switching operation, The switching path for a switching operation corresponds to a displacement path of the cam element 13, in which a cam track of a partial cam 15, 16, 17, 19, 20, 21 is switched over to a cam track of an adjacent partial cam 15, 16, 17, 19, 20, 21. The limiting mechanism 30 is designed to limit the displacement to avoid overshooting of the adjustable axial position at high speeds.

The valve drive device 10 comprises a positive locking element 29 connected to the cam element 13, which is intended for a positive connection with the limiting mechanism 30. The positive locking element 29 is designed as a single piece with the positive locking element 22, which is in permanent active connection with the switching element 26 of the switching actuator 23. In alternative designs, the positive locking element 29 can be designed separately from the positive locking element 22, which is in permanent active connection with the switching element 26 of the switching actuator 23. The positive connection of the positive locking element 29 with the limiting mechanism 30 is intended to block the axial displacement of the cam element 13 after completion of the switching movement and thus to limit the displacement path to the switching path.

The limiting mechanism 30 has a stop element 31 with two opposite stop surfaces 32, 33 for the positive locking element 29. The limiting mechanism 30 limits the displacement path by means of the two opposite stop surfaces 32, 33 when switching between cam tracks in two opposite axial directions, for example a first switching and a second switching, which restores an axial position of the cam element 13 before the first switching. In alternative designs, it is conceivable that the stop element 31 may have two stop surfaces 32, 33 facing away from one another for the positive locking element 29, which move in opposite axial directions into a blocking position before the displacement is carried out in order to limit the displacement path.

The stop surfaces 32, 33 are spaced at a distance 34 apart, which limits displacement to the value of the distance between adjacent cam tracks. The limiting mechanism 30 thus limits the displacement path of the cam element 13 to a switching path for a switching operation that corresponds to a distance between adjacent cam tracks. The distance 34 between the stop surfaces 32, 33 is constant. In alternative designs, it is conceivable that the stop element 31 is designed in such a way that the distance 34 between the stop surfaces 32, 33 can be changed, e.g., in order to enable switching by one or two cam track widths in one switching operation.

The limiting mechanism 30 includes an auxiliary actuator 35 for moving the stop element 31. The auxiliary actuator 35 is designed to move the stop element 31 by a distance of adjacent cam tracks. A switchover from a cam track of the outermost of the partial cams 15, 19 to a cam track of a respective other outermost partial cam 17, 21 is effected by a displacement of the cam element 13, in which switchover to the cam track of the central partial cam 16, 20 is effected and wherein the displacement path is limited by the stop element 31 of the limiting mechanism 30 to the switching path required for this purpose (see FIG. 1 and FIG. 2), a subsequent displacement of the stop element 31 by a distance of the adjacent cam spurs and a subsequent displacement of the cam element 13 by a further distance of adjacent cam tracks, the displacement path being limited by the stop element 31 of the limiting mechanism 30 to the switching path required for this purpose (see FIG. 3). The auxiliary actuator 35 moves the stop element 31 between a first switching position, in which it is possible to switch from a cam track of one of the outermost partial cams 15, 19 to a cam track of the middle part cam 16, 20 and vice versa, and a second switching position, in which it is possible to switch from a cam track of the middle part cam 16, 20 to a cam track of the other outermost part cam 17, 21 and vice versa.

The drive 25 for axial displacement of the switching element 26 is intended to be decoupled from switching element 26. A decoupling takes place when the stop element 31 of the limiting mechanism 30 forms a positive connection with the positive locking element 29. It is thus not necessary to stop the drive 25 precisely when the stop element 31 is form-fit with the positive locking element 29.

The switching actuator 23 comprises a slipping clutch 36, which is intended to decouple the switching element 26 and the drive 25 from each other. The spindle 24 is connected to the drive 25 via the slipping clutch 36. The slipping clutch 36 releases automatically on reaching a positive locking of the positive locking element 29, which is designed as a single piece with the positive locking element 22 for engagement with the switching element 26, and decouples the switching element 26 and the drive 25 from each other.

REFERENCE NUMERAL LIST

10 Valve drive device
11 Camshaft
12 Drive shaft
13 Cam element
14 Cam
15 Partial cam
16 Partial cam
17 Partial cam
18 Cam
19 Partial cam
20 Partial cam
21 Partial cam
22 Positive locking element
23 Switching actuator
24 Spindle
25 Drive
26 Switching element
27 Engagement groove
28 Camshaft housing
29 Positive locking element
30 Limiting mechanism
31 Stop element
32 Stop surface
33 Stop surface
34 Distance
35 Auxiliary actuator
36 Slipping clutch

The invention claimed is:

1. A valve drive device, comprising:

a camshaft having a cam element with a multi-track cam that is axially displaceable by a maximum displacement path;

a limiting mechanism, wherein, in at least one operating condition, a displacement path of the cam element is limited to a switching path for a switching operation; and a positive-locking element which is connected to the cam element and provides for a positive-locking connection to the limiting mechanism;

wherein the limiting mechanism includes a stop element with two opposite stop surfaces for the positive-locking element;

wherein the two opposite stop surfaces have a distance from one another which limits a displacement of the cam element to a value of a distance between adjacent cam tracks of the multi-track cam.

2. The valve drive device according to claim 1, wherein the limiting mechanism includes an auxiliary actuator and wherein the stop element is displaceable by the auxiliary actuator.

3. The valve drive device according to claim 1, wherein the multi-track cam has at least three cam tracks.

4. An internal combustion engine comprising a valve driving device according to claim 1.

5. A valve drive device, comprising:

a camshaft having a cam element with a multi-track cam that is axially displaceable by a maximum displacement path;

a limiting mechanism, wherein, in at least one operating condition, a displacement path of the cam element is limited to a switching path for a switching operation; and a switching actuator for axially displacing the cam element, wherein the switching actuator includes a switching element which is in permanent operative connection with the cam element and includes a drive for axial displacement of the switching element, wherein the drive is decoupleable from the switching element.

6. The valve drive device according to claim 5, wherein the switching actuator includes a slipping clutch, wherein the switching element and the drive are decoupleable from each other by the slipping clutch.

7. The valve drive device according to claim 6 further comprising a spindle, wherein a driving force from the drive to the switching element is transmittable by the spindle and wherein the spindle is connected to the drive via the slipping clutch.

8. A valve drive device, comprising:

a camshaft having a cam element with a multi-track cam that is axially displaceable by a maximum displacement path;

a limiting mechanism, wherein, in at least one operating condition, a displacement path of the cam element is limited to a switching path for a switching operation;

a positive-locking element which is connected to the cam element and provides for a positive-locking connection to the limiting mechanism; and a switching actuator for axially displacing the cam element, wherein the switching actuator includes a switching element which is in permanent operative connection with the cam element and includes a drive for axial displacement of the switching element, wherein the drive is decoupleable from the switching element, and wherein the switching element is in permanent operative connection with the positive-locking element.

* * * * *